US005536312A

United States Patent [19]

Madrzak et al.

[11] Patent Number: 5,536,312

[45] Date of Patent: Jul. 16, 1996

[54] DOCTOR DEVICE

[75] Inventors: Zygmunt Madrzak, Heidenheim; Bernd Kaufmann, Steinheim, both of Germany

[73] Assignee: Voith Sulzer Papiermaschinen GmbH, Heidenheim, Germany

[21] Appl. No.: 378,625

[22] Filed: Jan. 26, 1995

[30] Foreign Application Priority Data

Jan. 27, 1994 [DE] Germany ..... 44 02 226.3

[51] Int. Cl.[6] ..... B05C 1/00

[52] U.S. Cl. ..... 118/118; 15/256.5; 101/157; 101/169; 101/365; 118/119; 118/123; 118/126; 118/261; 118/113; 118/419; 162/281

[58] Field of Search ..... 118/118, 119, 118/123, 126, 261, 413, 419; 427/356; 162/281; 15/256.5; 101/157, 169, 365

[56] References Cited

U.S. PATENT DOCUMENTS

| | | | |
|---|---|---|---|
| 4,651,672 | 3/1987 | Sommer | 118/126 |
| 4,757,763 | 7/1988 | MacPhee et al. | 118/203 |
| 4,953,252 | 9/1990 | Akisawa | 15/256.51 |
| 5,119,755 | 6/1992 | Beisswanger | 118/261 |
| 5,282,420 | 2/1994 | Hara et al. | 15/256.51 |
| 5,437,227 | 8/1995 | Straubinger | 101/157 |

FOREIGN PATENT DOCUMENTS

| | | |
|---|---|---|
| 0109520 | 10/1983 | European Pat. Off. . |
| 2822682 | 11/1979 | Germany . |

*Primary Examiner*—Laura Edwards
*Attorney, Agent, or Firm*—Baker & Daniels

[57] ABSTRACT

A doctor device, notably for machines used to coat paper or cardboard, with a relatively bendable, flexible doctor element fitted in or on a separate holder. At least along its length in the holder, the device features a convex crowning of its working surface about its longitudinal axis.

6 Claims, 4 Drawing Sheets

DOCTOR DEVICE

BACKGROUND OF THE INVENTION

The invention concerns a doctor device, notably for use with machines for coating paper or cardboard. The doctor device has a relatively bendable, flexible, tape-type thin and line-shaped doctor element fitted or held in or on a separate holder. Such a device is known from DE-OS 2,822,682. Here, a so-called blade, whose trailing edge (longitudinal edge) forms the dosing, or smoothing edge, is movably mounted in the holder. The blade may be fashioned as a long strip so that, by a movement along the surface of the backing roll carrying the paper web, a continuous change of its working area may be imparted.

A device according to EP 0 109 520 is a dosing system for coating mixture used to coat webs of paper or cardboard. It has a holder in which a doctor strip is mounted in a guide slot. The doctor strip has a slightly flexible design in that it features on its back side numerous parallel incisions forming sort of a comb strip. The doctor surface proper is convex and ends in an abrupt edge, which is a major feature of this device. The working surface of the doctor strip is smooth and, due to its abrupt leaving edge, not suited to be provided with grooves to enable a volumetric dosing. Furthermore, the doctor strip is a relatively expensive element, which is a disadvantage when repeated replacement is required.

The problem underlying the present invention is to provide a doctor device which allows a very universal use, has a long service life in terms of wear and can be made at relatively low cost.

SUMMARY OF THE INVENTION

This problem is solved by the features of the present invention. The doctor element of the doctor device features, at least along its length in the holder, a convex crowning of its working surface about its longitudinal axis.

Owing to its blade-shaped design, the doctor element allows a very low-cost manufacture. It also offers numerous options, for instance by application of pressure on its concave side, making it possible to vary the crowning of the doctor blade. On the other hand, the doctor blade may also be fashioned as a very long doctor strip which can be wound on drums arranged on both ends of its working area. With little feed during operation, wear can be kept very uniform across the entire strip length, which results in a very long service life of the doctor strip. Since the doctor blade is flat in its original state, the lands (or grooves situated in between) for volumetric dosing of the coating mixture can be created in a very accurate manner.

BRIEF DESCRIPTION OF THE DRAWINGS

The invention will be described hereafter with the aid of the figures of the appended drawing, wherein.

DETAILED DESCRIPTION OF THE INVENTION

Figure 1:
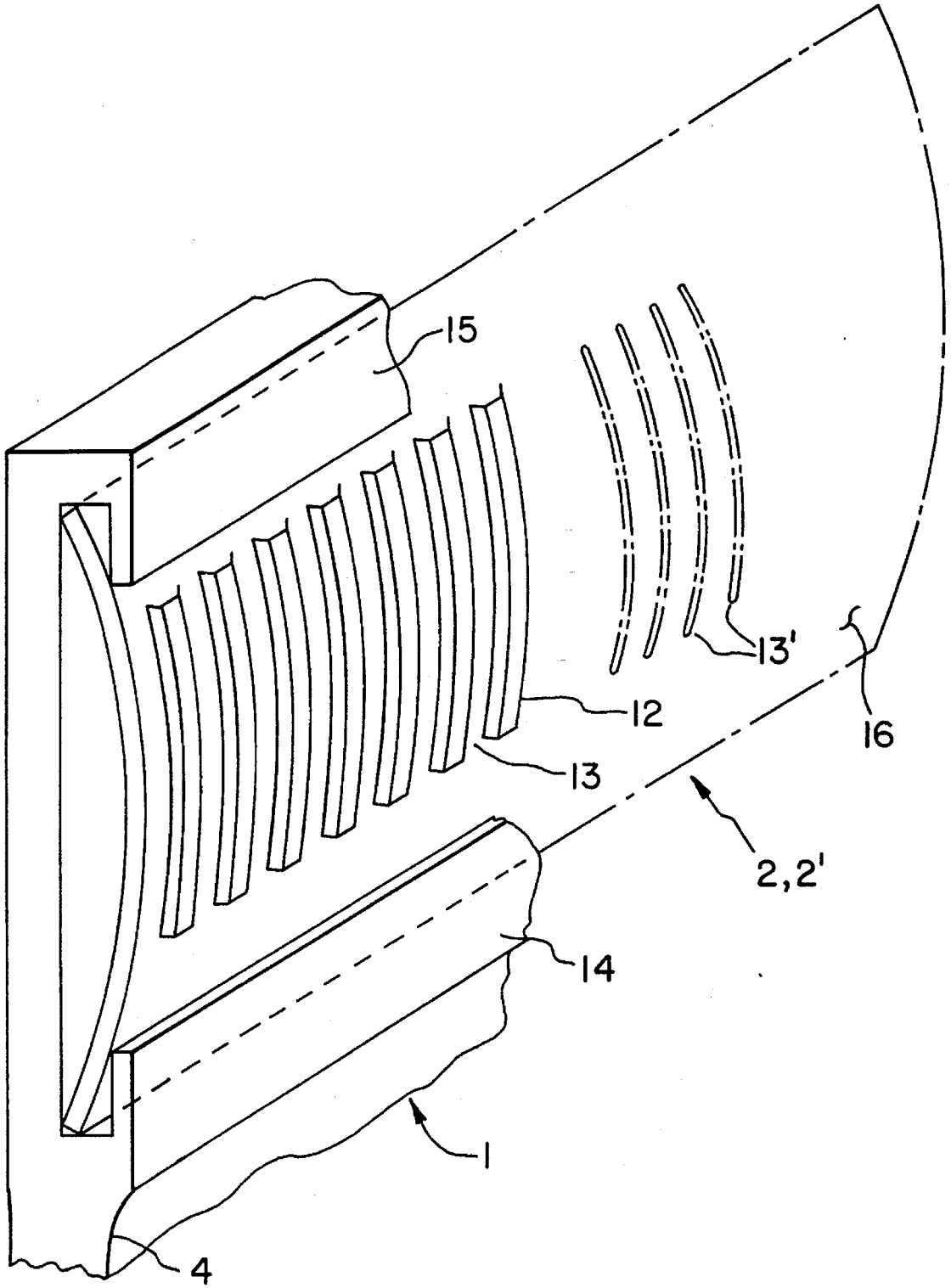
FIG. 1 is a perspective illustration of the doctor device.

In FIG. 1, the doctor strip 2 is clamped, or mounted, across its appropriate length in a holder 4, with the aid of clamping devices, or projections, 14 and 15 of said holder, so that the mounting produces the crowning—a convex crowning of the working surface 16. In its state as manufactured, the doctor blade is flat. It features crownings 12 and interjacent grooves 13 transverse to its longitudinal axis, so as to volumetrically dose the coating mixture according to the cross section of the grooves 13.

Figure 2:
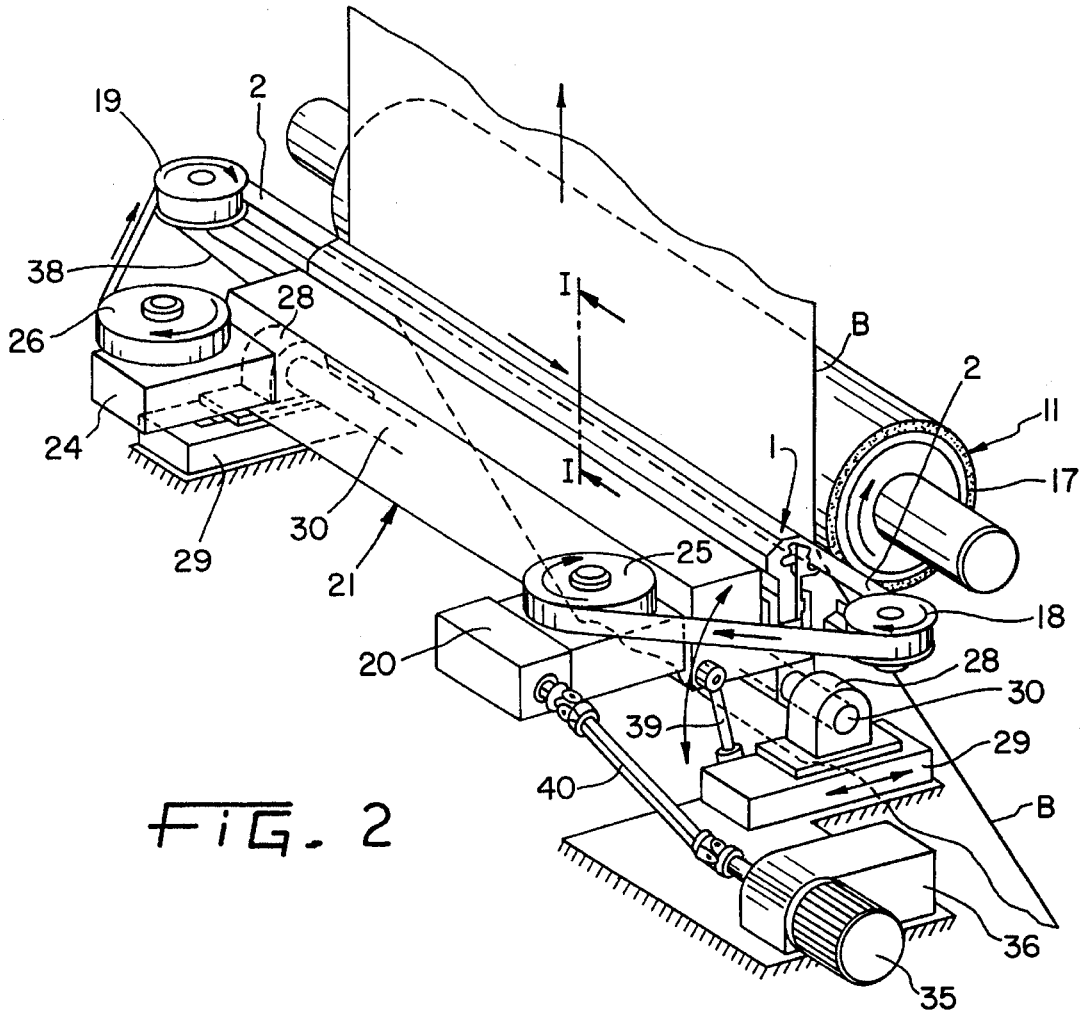
FIG. 2 is a perspective illustration of the coating system in which the doctor device is installed.

The entire doctor device is referenced 1. FIG. 2 depicts its installation on the coating device, in which the web B is carried by a backing roll 11 with a core of steel and a rubber coating 17. Winding drums 25 and 26 are provided on both ends of the doctor device, and a motor 35 drives the gearbox 20 by way of the jointed rod 40, and thus the winding drum 25. Presently, a very long doctor strip 2 runs additionally over idler pulleys 18 and 19 mounted on extension arms 38, allowing the doctor strip to change outside the actual working area from its curved shape to a straight, or stretched shape. The doctor strip 2 can be reused also in the opposite direction, as marked by arrows, by providing for the winding drum 26 a drive corresponding to that for the drum 25.

The doctor device 1 is mounted on a doctor beam 21 which by way of a slide 29 can be moved toward the backing roll 11 according to the double arrow. But it can be moved also relative to the backing roll, by means of connecting rod 39, due to its being mounted on journals 30 in bearings 28. This makes it possible to vary the contact area of the doctor blade on the web B, or backing roll 11, in order to thereby replace a worn spot of the doctor blade by a "fresh" one for the dosing operation or to achieve over a long period of time a uniform and correspondingly reduced wear of the entire doctor strip.

Figure 3:
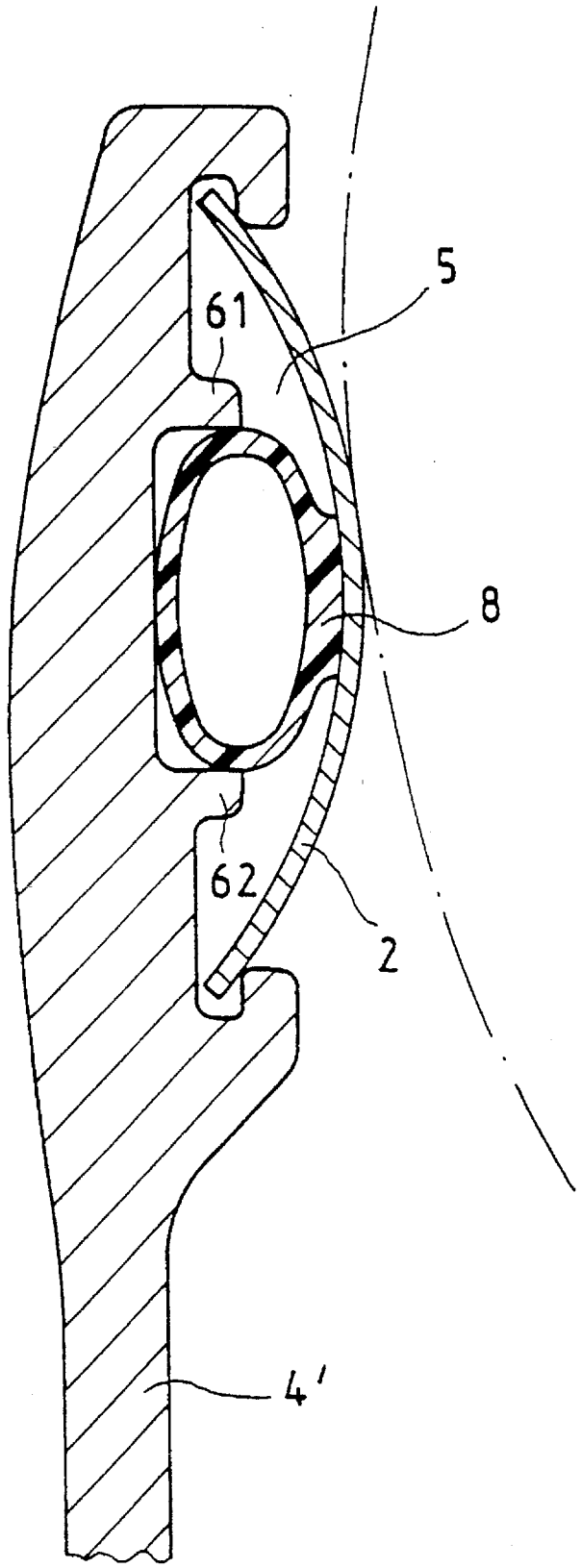
FIG. 3 is a cross section through another embodiment of the doctor device.

FIG. 3 illustrates in principle a variant where an adjustable crowning can be imparted to the doctor blade 2 by a pressure body, such as pressure hose 8, provided in the space 5. Theoretically, the space 5 also could be subjected to the pressure of a liquid or gaseous medium, but this entails sealing problems on the ends of the doctor blade, requiring the installation of suitable rubber seals. In this case, the holder 4' features projections 61 and 62 for retaining the pressure hose 8.

The projections (lands 12), or the interjacent grooves 13, can be created by sintering, or alternatively, by more modern methods, such as PVD (physical vapor deposition) or CVD (chemical vapor deposition). FIG. 1 also indicates that grooves 13' can be cut into the doctor blade 2' by means of a laser, when very fine grooves are required. The same is true for making them by high-pressure water jets. It is also possible, of course, to create the grooves by machining.

Figure 4:
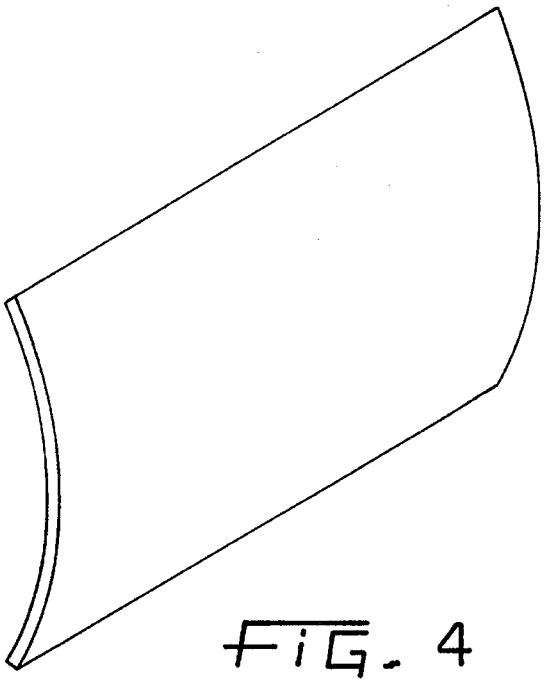
FIG. 4 is a perspective illustration of a smooth doctor blade crowned about its longitudinal axis.

FIG. 4 shows that the doctor blade 2' also may be completely flat, notably fashioned with a smooth working surface, in case the dosing is not performed volumetrically, but hydrodynamically. In this instance, in the ever more narrowing gap (between the doctor blade and the backing roll or the web carried by it) a hydrodynamic pressure is generated in the coating mixture. An arrangement according to FIG. 3, with adjustable crowning, makes it possible to influence the type of application. Of course, this doctor blade may be provided with a wear-resistant coating also by the usual coating methods, which in part have already been mentioned above. Notably the fluid-bed sintering method appears to recommend itself here. Flame spraying is applicable as well. In this process, liquid hard alloy, especially carbides or oxides, are at high pressure sprayed on the surface by means of a gun. Very high pressures are applied in the process.

With appropriate coating methods, of course, the doctor blade can as such be made also of a plastic material while only the facing is made of wear-resistant material, such as carbides or oxides, provided a sufficiently firm anchoring of the wear-resistant material on the doctor blade can be accomplished.

The curvature of the doctor blade may be so chosen that a maximum flexure (maximum distance from the chord drawn through the ends of the doctor blade) between 0.1 and 0.4 mm per mm of width, or height, of the doctor blade will result. The doctor blades have generally a width (height) between 60 and 120 mm in their uncrowned, i.e. new state.

Figure 5:
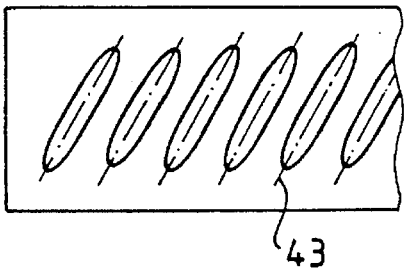
FIGS. 5 through 11, illustrate optional arrangements of the grooves or lands of the doctor strip, with FIG. 8*a* and 9*a* showing the respective cross sections.
Figure 6:
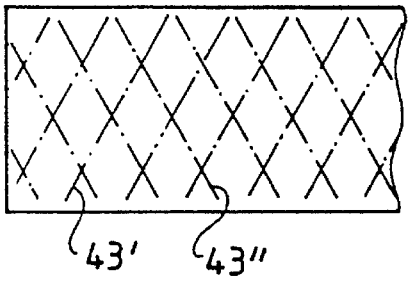
Figure 7:
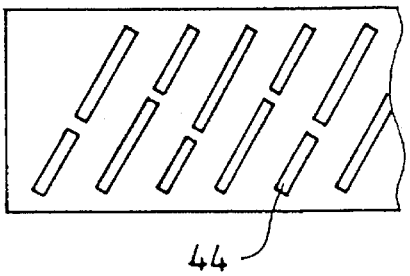
Figure 8:
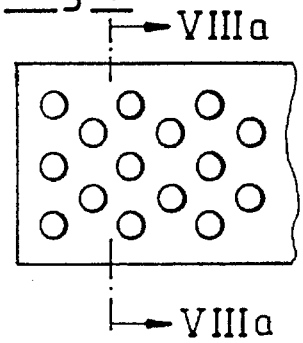
Figure 8A:
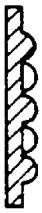
Figure 9:
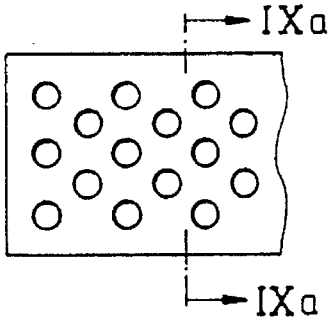
Figure 9A:
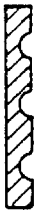

In case the doctor blade 2, or doctor strip, features grooves 43, these may extend obliquely to the longitudinal edges of the doctor blade or doctor strip, as shown in FIG. 5. Intersecting grooves (or narrow lands) 43' and 43" according to FIG. 6 may be provided as well. According to FIG. 7, the grooves 44, or lands, may also be interrupted regularly or, at least viewed across the entire blade, irregularly.

Figure 10:
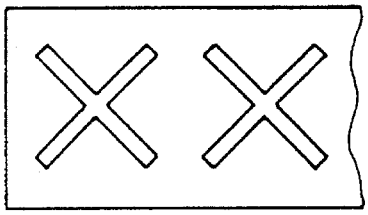
Figure 11:
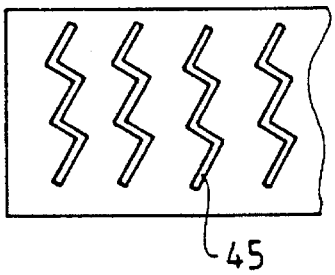

According to FIGS. 8 and 8*a*, or 9 and 9*a*, compact small bosses or depressions (dimples) may be distributed regularly over the doctor blade. FIG. 10 shows grooves or lands in the form of crosses. The grooves 45 or lands according to FIG. 11 extend in zigzag fashion.

What is claimed is:

1. A doctor device for machines for coating paper or cardboard, comprising:

a flexible line-shaped doctor blade, said doctor blade comprising a windable strip having a longitudinal axis and a working surface along said longitudinal axis;

a respective winding element operatively attached to each end of the doctor device, said windable strip extending between said winding elements;

means for driving at least one of said winding elements to wind said strip; and a holder arranged and configured in said doctor device for holding said doctor blade along a length of the doctor blade, said holder being fitted with a clamping device structured and arranged to hold the doctor blade at a tension that causes convex crowning of said working surface about said longitudinal axis.

2. The doctor device of claim 1, wherein the doctor blade has grooves and lands, said grooves and lands arranged so as to alternately extend transverse to said longitudinal axis on the working surface.

3. The doctor device of claim 1, further comprising an adjustable pressure body in a pressure space for adjusting the crowning of the doctor blade, said pressure space in or on the holder on a concave side of the doctor blade.

4. The doctor device of claim 3, wherein the pressure body comprises a pressure hose.

5. The doctor device of claim 1, wherein the length of the doctor blade is adjustable to multiple lengths based on a working width of the coating machine.

6. The doctor device of claim 1, wherein the holder is pivotable about an axis parallel to the longitudinal axis of the doctor blade to alter the working surface of the doctor blade.

* * * * *